US005669112A

United States Patent [19]

Huang

[11] Patent Number: 5,669,112

[45] Date of Patent: Sep. 23, 1997

[54] PACKAGE FILM DEVICE

[76] Inventor: Fu-Chuan Huang, 7, Chung Chuang Tsuen, Shui Shang Town, Chia-Yi Hsien, Taiwan, Taiwan

[21] Appl. No.: 597,203

[22] Filed: Feb. 6, 1996

[51] Int. Cl.[6] ..... B65D 63/00; A44B 21/00

[52] U.S. Cl. ..... 23/16 R; 24/3.6; 24/336; 24/545

[58] Field of Search ..... 24/16 R, 17 R, 24/18, 716, 545, 563, 336, 335, 339, 67.9, 3.1, 3.6; 53/548

[56] References Cited

U.S. PATENT DOCUMENTS

| | | | |
|---|---|---|---|
| 374,702 | 12/1887 | Rand | 24/336 |
| 1,318,261 | 10/1919 | Bryan | 24/545 |
| 1,332,014 | 2/1920 | Wilson | 24/3.6 |
| 1,341,930 | 6/1920 | Roblin | 24/3.6 |
| 2,271,393 | 1/1942 | Fulton | 24/3.1 |
| 4,107,823 | 8/1978 | Siesto | 24/3.6 |
| 4,979,714 | 12/1990 | Russell et al. | 24/716 |

*Primary Examiner*—Victor N. Sakran
*Attorney, Agent, or Firm*—Larson and Taylor

[57] ABSTRACT

A package film device for closely packaging two objects includes a sheet like film having one edge secured to the middle portion and having the other edge secured to one end portion. The film may thus form two spaces for receiving the objects and is arranged to form a partition between the spaces for closely engaging with the outer peripheral surfaces of the objects. The film may shrink under heat in order to closely engaging with and to hold the objects in place.

1 Claim, 2 Drawing Sheets

PACKAGE FILM DEVICE

BACKGROUND OF THE INVENTION

1. Field of the Invention

The present invention relates to a package, and more particularly to a package film device.

2. Description of the Prior Art

A typical package film is shown in FIG. 1 and comprises a sheet body 90 for engaging around the objects 3 to be packaged. The sheet body 90 will be heated and will shrink under heat so as to solidly hold the objects 3 in place. The objects 3 may thus be solidly packaged within the sheet body 90. However, as clearly shown in FIG. 1, when the objects 3 include a circular cross section, the sheet body 90 may not closely engaging with the outer peripheral surfaces of the objects 3 and one or more gaps or rooms 91 may be formed between the sheet body 90. The objects 3 may thus be contaminated by the dirt entering into the rooms 91.

The present invention has arisen to mitigate and/or obviate the afore-described disadvantages of the conventional package films.

SUMMARY OF THE INVENTION

The primary objective of the present invention is to provide a package film device in which the sheet body may closely engage with the outer peripheral surfaces of the objects.

In accordance with one aspect of the invention, there is provided a package film device for packaging two objects, the package film device comprises a sheet body including a middle portion, a first end portion, a first edge secured to the middle portion, and a second edge secured to the first end portion so as to define two spaces for receiving the objects and so as to form a partition between the spaces.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
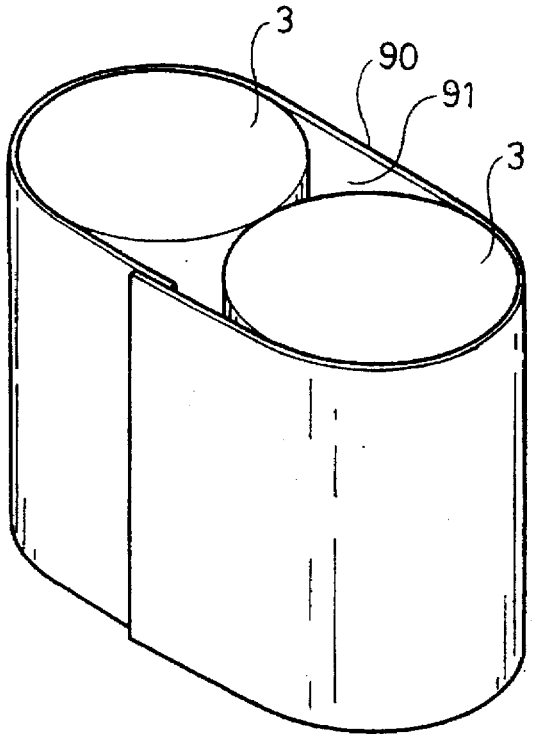
FIG.1 (PRIOR ART)
FIG. 1 is a perspective view of a typical package film device.
Figure 2:
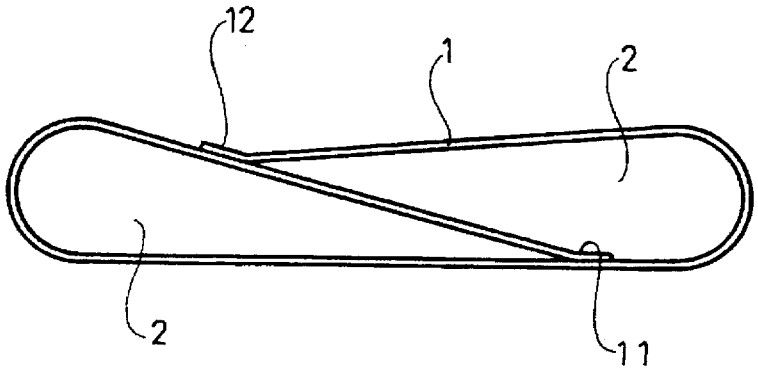
FIG. 2 is a top plane view of a package film device in accordance with the present invention.
Figure 3:
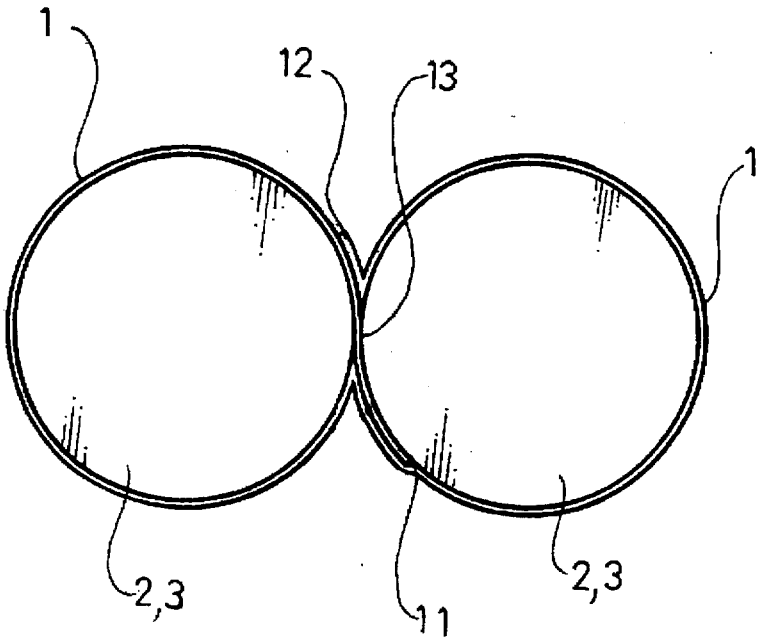
FIG. 3 is a top plane view illustrating an application of the package film device.

Referring to the drawings, and initially to FIGS. 2 and 3, a package film device in accordance with the present invention comprises a sheet body 1 including a first edge 11 secured to the middle portion and including a second edge 12 secured to the first end portion so as to form a partition 13 and so as to define two spaces 2 for receiving two objects 3 therein respectively. The partition 13 is formed between the two spaces 2. The spaces 2 have a size slightly larger than that of the objects 3 such that the objects 3 may be easily engaged in the spaces 2. The sheet body 1 will then be heated such that the sheet body 1 may shrink under heat in order to solidly hold the objects 3 in place. The objects 3 may thus be solidly packaged and held within the two spaces 2 of the sheet body 1. The sheet body 1 may thus be solidly engage with the outer peripheral surfaces of the objects 3.

It is to be noted that the sizes of the spaces 2 may be identical or different from each other. The sizes of the spaces 2 are determined according to that of the objects 3 to be packaged.

Figure 4:
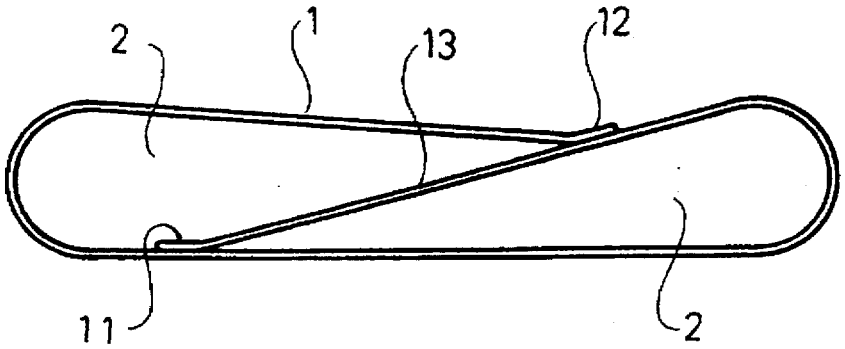
FIG. 4 is a top plane view showing another arrangement of the package film device.

Referring next to FIG. 4, the sheet body 1 may be arranged in a mirror-image construction which also includes a partition 13 formed between two spaces 2.

Accordingly, the package film device in accordance with the present invention includes a sheet body having a partition formed between two spaces so as to closely engage with the outer peripheral surfaces of the objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A package film device for packaging two objects, said package film device comprising:

a sheet body of a flexible packaging film including a middle portion, a first end portion, a first edge secured to said middle portion, and a second edge secured to said first end portion so as to define two spaces for receiving the objects and so as to form a partition between said spaces.

* * * * *